US007364499B1

(12) United States Patent
Karppinen et al.

(10) Patent No.: US 7,364,499 B1
(45) **Date of Patent: *Apr. 29, 2008**

(54) ORBITAL SANDER WITH LIQUID DISPENSER HOUSING

(76) Inventors: Rodney J. Karppinen, 416 Kensington Ave. NW., Orting, WA (US) 98360; Timothy D. Lindula, 16306 - 43rd St. East, Sumner, WA (US) 98390

( * ) Notice: Subject to any disclaimer, the term of this patent is extended or adjusted under 35 U.S.C. 154(b) by 0 days.

This patent is subject to a terminal disclaimer.

(21) Appl. No.: 11/707,557

(22) Filed: Feb. 15, 2007

Related U.S. Application Data

(63) Continuation-in-part of application No. 11/451,696, filed on Jun. 13, 2006, now Pat. No. 7,189,154.

(60) Provisional application No. 60/690,817, filed on Jun. 13, 2005.

(51) Int. Cl.
*B24B 55/02* (2006.01)

(52) U.S. Cl. ..... 451/449; 451/357

(58) Field of Classification Search ..... 451/449, 451/450, 344, 357–359, 350–353, 446; 83/168–171
See application file for complete search history.

(56) References Cited

U.S. PATENT DOCUMENTS

| | | | | |
|---|---|---|---|---|
| 4,102,084 | A | 7/1978 | Bloomquist | |
| 4,216,630 | A | 8/1980 | Smart et al. | |
| 5,597,348 | A | 1/1997 | Hutchins | |
| 5,649,508 | A * | 7/1997 | Rost et al. | 222/191 |
| 5,651,727 | A | 7/1997 | Weinstein et al. | |
| 6,132,301 | A | 10/2000 | Kaiser | |
| 6,595,196 | B2 | 7/2003 | Bath | |
| 7,115,018 | B1 * | 10/2006 | Syverson | 451/6 |
| 7,144,312 | B2 * | 12/2006 | Boyle | 451/449 |
| 7,189,154 | B1 | 3/2007 | Karppinen et al. | |

* cited by examiner

*Primary Examiner*—Dung Van Nguyen
(74) *Attorney, Agent, or Firm*—Dean A. Craine

(57) ABSTRACT

An orbital sander liquid dispenser that includes a head with a hollow fluid distribution ring attached thereto that includes a plurality of jet openings formed on its bottom surface design to spray a desired liquid onto the working surface. A liquid is pumped by means of a submerged electric pump to the head and into the ring from a reservoir. An optional foot switch is provided for control the flow of liquid to the head.

13 Claims, 7 Drawing Sheets

ORBITAL SANDER WITH LIQUID DISPENSER HOUSING

This is a continuation in part patent application based on the utility patent application entitled Orbital Sander with Liquid Dispenser (Ser. No. 11/451,696) filed on Jun. 13, 2006, now U.S. Pat. No. 7,189,154 which was based on the provisional patent application (Ser. No. 60/690,817) filed on Jun. 13, 2005.

BACKGROUND OF THE INVENTION

1. Field of the Invention

The invention disclosed herein pertains to rotary sanders and polishers, and more particularly to rotary sanders and polishers used to finish surfaces.

2. Description of the Related Art

Pneumatic and electric orbital sanders are commonly used in the automotive repair industry for sanding and polishing surfaces. Although available in different sizes, sanders used in the automotive repair industry are relatively small and are designed to be held and operated in one hand.

As shown in FIGS. 1-3, pneumatic and electric sanders, denoted 84 and 100, respectively, include a small head, 85 and 101 with a pneumatic motor 87 or electric motor 102, respectively, mounted therein. The shaft of each motor 87 or 102 is attached to a rigid support disc 89 or 106, respectively. Attached to the bottom surface of each support disc 89 or 106, is a circular hook connector 90 or 107 that connects to a replaceable, foamed-backed sanding or polishing disc 110 shown in FIG. 11.

Mounted on the top surface of the head 85, 101 is a plunger switch 88, 104 which the user presses against to activate the motor 87, 102, respectively. Formed on the rear surface of the head 85, 101 is a connector mounting surface 86, 103, respectively. Formed on the connector mounting surface 86, 103 on a pneumatic sander is an air inlet port 92 and an air exhaust port 93. The air inlet port 92 is threaded and designed to connect to a threaded connector 95 connected to the end of an air pressure line 94. The air exhaust port 93 is also threaded and designed to connect to the threaded bolt 97 that extends longitudinally from an air exhaust valve 97. On electric sanders 100, the air inlet port is replaced with an electrical cord 108 and the threaded bolt 116 on the air exhaust valve 115 connects to the threaded air exhaust port 105.

When sanding, it is well known to wet the sanding surface to expedite the sanding process. Unfortunately, when sanding sloped surfaces or large areas, it is difficult to keep the surface wet. Typically, the operator must stop the sander and apply water or other liquids, such as wax or polishing solutions to the surface with a hose or a spray bottle. Often, the area around the working surface does not need repair or is liquid sensitive and greater attention is needed to keep these areas dry.

What is needed is an orbital sander with a liquid dispenser that automatically and continuously applies a desired quantity of a desired liquid, such as water, wax or polishing solution to a surface to be treated. What is also needed is an orbital sander with a liquid dispenser that allows the user to control more precisely the amount of liquid applied to the surface.

SUMMARY OF THE INVENTION

These and other objects are met by the orbital sander with a liquid dispenser disclosed herein. The dispenser is designed to be used either with a hand held electric or pneumatic powered orbital sander that includes a head with a connector surface formed thereon. In the first embodiment, the dispenser includes an adapter that includes a mounting ear with at least one bore formed thereon which is aligned and registered with an air inlet port or an exhaust air port on the head's connector surface. The connectors on an air pressure line and on an exhaust air valve may extend through the bores and into the air inlet port and exhaust air port, respectively, to securely attach the adaptor to the head.

As shown in FIGS. 1-3, a connecting mounting surface is formed on the rear surface of the head. The adapter is positioned adjacent to the mounting surface. Attached to the adaptor is a liquid delivery ring that extends forward and around the front surface of the head. The ring is hollow and includes a plurality of jet openings evenly spaced apart on the ring's bottom surface. The opposite ends of the ring are open and extend into side openings formed by a transverse liquid conduit formed inside the adaptor. Also formed in the adaptor is a centrally aligned main liquid conduit that extends from the adaptor's rear surface and into the adaptor. The main liquid conduit terminates at the transverse liquid conduit thereby forming a "T-shaped" conduit inside the adapter. A liquid delivery tube connects to the main liquid conduit while the ends of the ring fit snuggly into the side openings.

The opposite, distal end of the liquid delivery tube is connected to an electric pump. In the preferred embodiment, a foot switch is connected to the pump which allows the user to easily control the delivery of liquid to the sander with his or her foot. In the preferred embodiment, the liquid is placed into a bucket and the pump is then submerged into the bucket.

On an electric orbital sander an electric power cord is connected to the sander's head and replaces the air pressure line used with a pneumatic sander. Also formed on the adapter is an exhaust filter bore through which the exhaust air filter extends and attaches to the head. The exhaust filter helps to align and attach the adapter to the sander head.

As noted above, the opposite ends of the ring are disposed inside the transverse conduit and a plurality of jet openings formed on the ring's lower surface through which the liquid is dispensed onto the working surface. The ends of the ring can rotate inside the adaptor thereby allowing the user to adjust the pitch of the ring with respect to the head to control the area of the surface that is wet.

In the second embodiment, a modified head is used, which includes an air inlet port, and exhaust port, a main liquid conduit, a transverse liquid conduit and two side openings in which the opposite ends of the liquid delivery ring attaches.

In the preferred embodiment, a manual valve is attached to the proximal end of the liquid delivery tube thereby allowing the operator to selectively control the volume of liquid delivered to the surface. Also, an optional a check valve is attached to the distal end of the liquid delivery tube that prevents liquid from back flowing in the liquid delivery tube thereby maintaining a column of liquid in the liquid delivery tube to provide an instant ON or OFF feature.

Clay is commonly used as an abrasive on surfaces. Typically, large amounts of water must be used with the clay however. An important benefit of the above described dispenser is that it allows clay discs to be used. In order to use the dispenser with clay discs, a clay disc attachment system must be used. The clay disc attachment system includes a cylindrical clay disc holder that attaches to the supporting disc on the orbital sander. Formed on the clay disc holder is a disc cavity with a mesh layer formed therein that securely holds the clay disc inside the cavity and prevents the clay disc from rotating.

DESCRIPTION OF THE PREFERRED EMBODIMENT(S)

Figure 1:
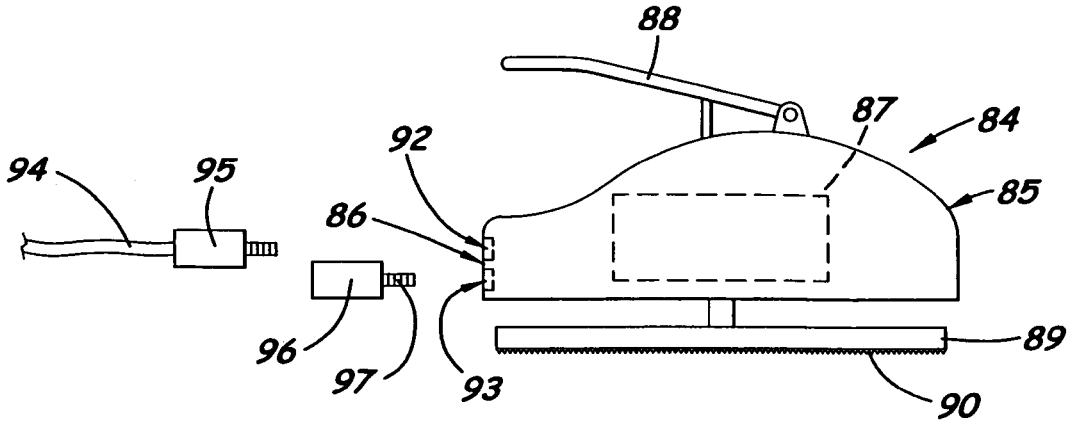
Fig. 1 (PRIOR ART)
FIG. 1 is a side elevational view of a pneumatically controlled, palm size orbital sander found in the prior art.

Referring to the accompanying FIGS. 3-16, there is shown an orbital sander with a liquid dispenser that sprays a desired liquid 120 onto the working surface as the sander 84, 100 is being operated. Moreover, to attachments attached to an existing hand held orbital sander or polisher that dispenses a limited volume of liquid directly on the desired working surface 5.

In the first embodiment, the dispenser 10 includes an adaptor 12 mounted to the connector mounting surface 86 or 102 located on the head 85 or 101 on a pneumatic or electric sander 84 or 100, respectively. Attached to the adaptor 12 is a hollow liquid delivery ring 40 which is filled with a pressurized liquid 120 used with sanding or polishing. The ring 40 is a split ring structure with two opposite open ends 42 and 44. Formed on the bottom surface 41 of the ring 40 is a plurality of jet port openings 46 designed to spray liquid 120 to the working surface 5.

Figure 2:
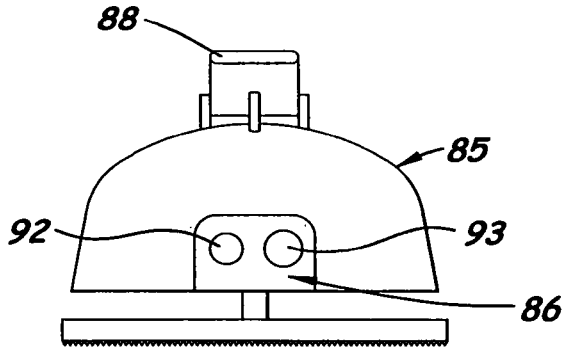
Fig. 2 (PRIOR ART)
FIG. 2 is an end elevational view of the pneumatically control orbital sander shown in FIG. 1.
Figure 3:
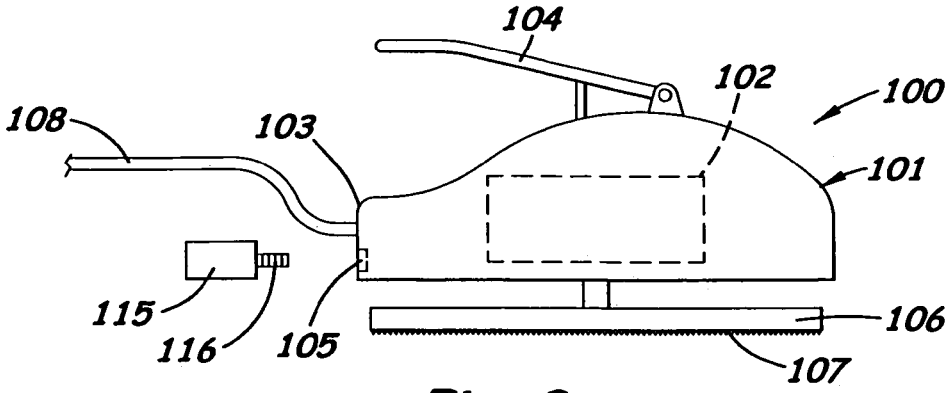
Fig. 3 (PRIOR ART)
FIG. 3 is a side elevational view of an electric palm size orbital sander found in the prior art.
Figure 4:
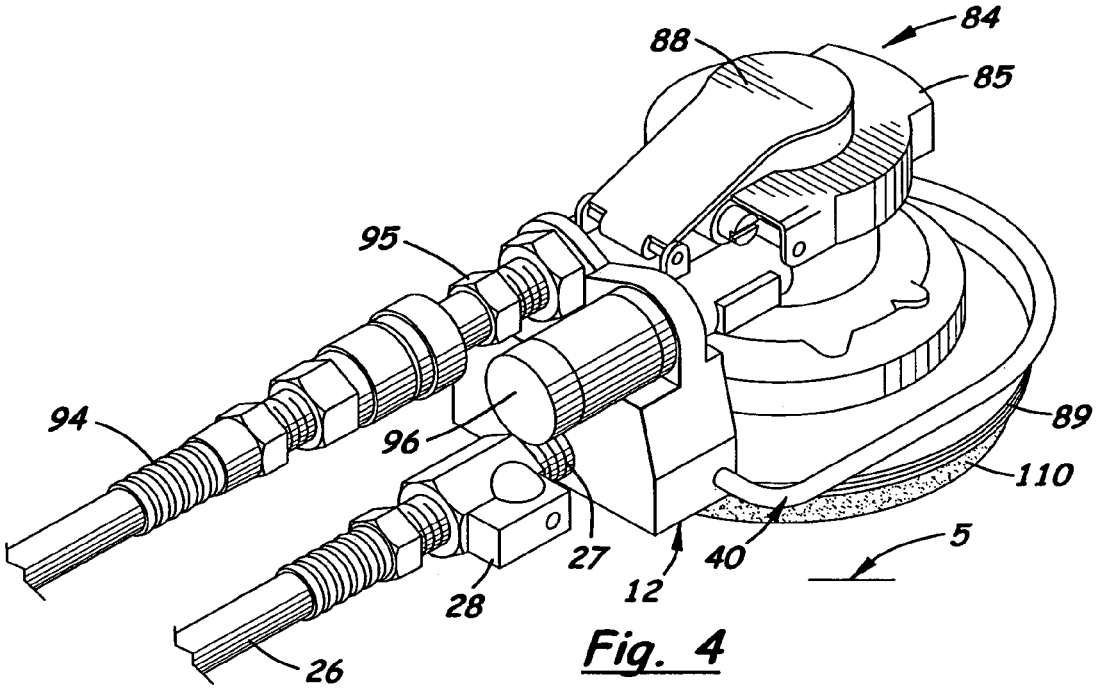
FIG. 4 is a perspective view of the first embodiment of the pneumatically driven orbital sander with the liquid dispensing system attached thereto.
Figure 6:
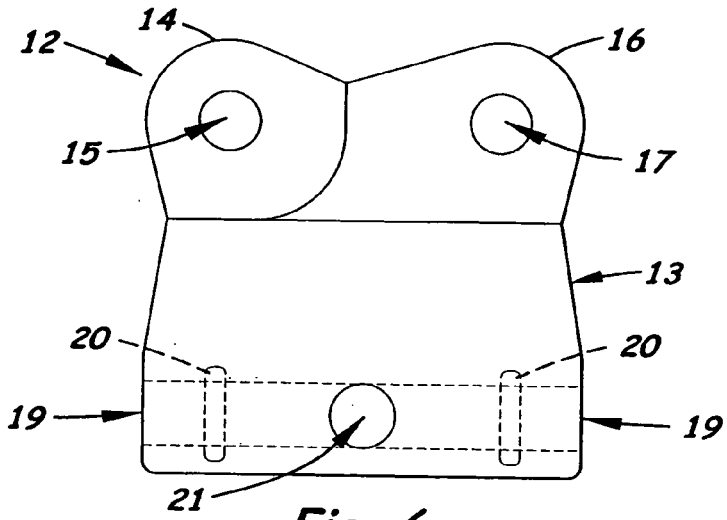
FIG. 6 is a rear elevational view of the adapter.
Figure 7:
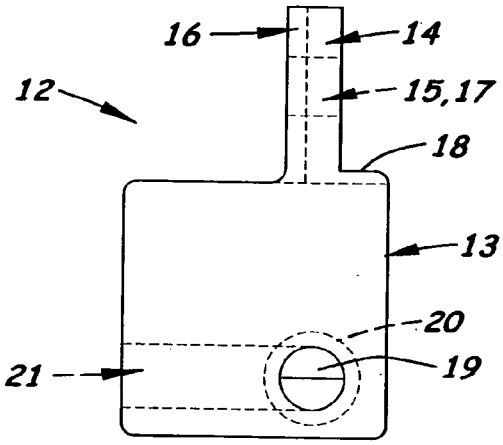
FIG. 7 is a left side elevational view of the adapter.
Figure 8:
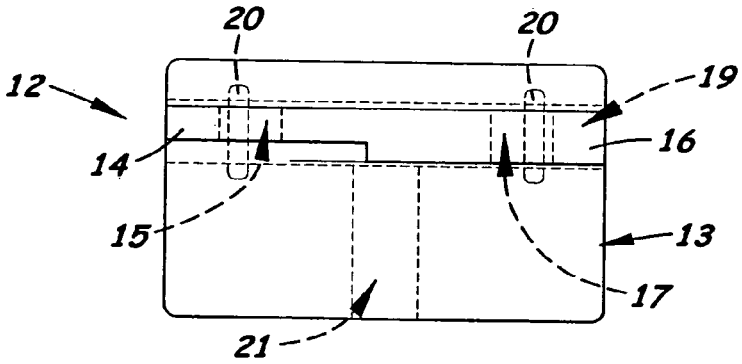
FIG. 8 is a top plan view of the adapter.

The adaptor 12, shown more clearly in FIGS. 6-8, includes a rectangular lower body 13 with two upward extending narrow ears 14 and 16. Formed on the left ear 14 is an air inlet bore 15. Formed on the right ear 16 is an exhaust air bore 17. The left and right ears 14, 16 are offset and slightly rearward from the front surface of the body 13. Formed in front of the ears 14 and 16 is a nesting surface 18 designed to fit against the rear surface of the sander head. The locations of the bores 15 and 17 are designed to match the locations of the air inlet port 92 and exhaust air port 93 on a pneumatic sander 84 shown in FIGS. 1 and 2. When used with an electric sander 100 as shown in FIG. 3, the left ear 14 and bore 15 maybe eliminated. The diameters of the bores 15 and 17 must be sufficient so that a threaded connector 95 on the air pressure line 95 and the threaded bolt 97 on the exhaust air valve 96, respectively, may extend through to attach the adapter 12 to the head 85.

During assembly, the adaptor 12 is located adjacent to the connecting mounting surface 86 or 102 on the head 85 or 101, respectively. The bores 15 and 17 are then aligned and registered with the air inlet port 92 and exhaust air port 93. The air pressure line 95 is then grasped and the threaded connector 95 is inserted through bore 15 and tightened into the air inlet port 92. The exhaust air valve 96 is grasped.

Formed inside the adaptor's lower body 13 is a transversely aligned, liquid conduit 20. Formed near the opposite openings into the conduit 20 are two circular O-ring voids 22, and 24. During assembly, an O-ring 29 is placed inside each O-ring void 22, 24. The center hole on each O-ring 29 is slightly smaller than the diameter of the ring 40 thereby creating a water tight seal when the end of the ring 40 is inserted therein.

Extending from the rear surface of the lower body 13 is a centrally aligned threaded main liquid conduit 26. The conduit 26 extends from the rear surface of the adapter 12 to the transverse conduit 20 thereby creating a continuous T-shaped conduit During assembly, the threaded connector 51 on a liquid delivery tube 50 connects to the main liquid conduit 26 to deliver liquid to the adaptor 12.

Figure 9:
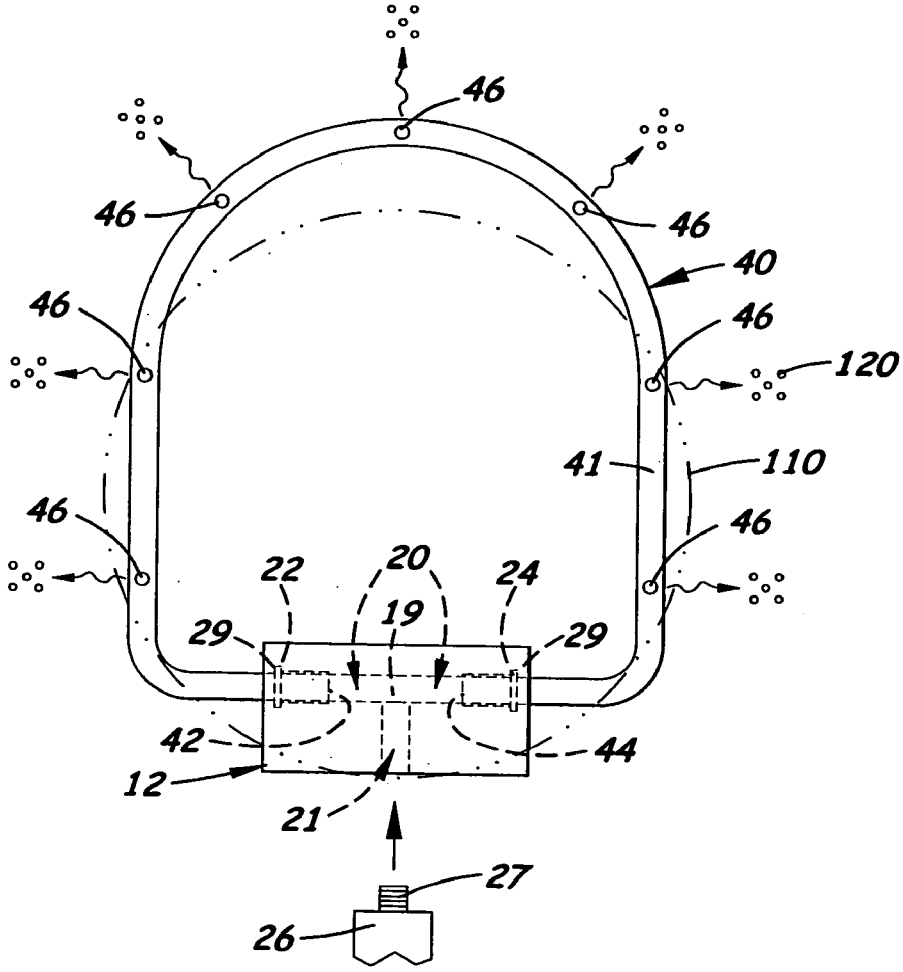
FIG. 9 is a bottom plan view of the dispensing ring and adapter.
Figure 10:
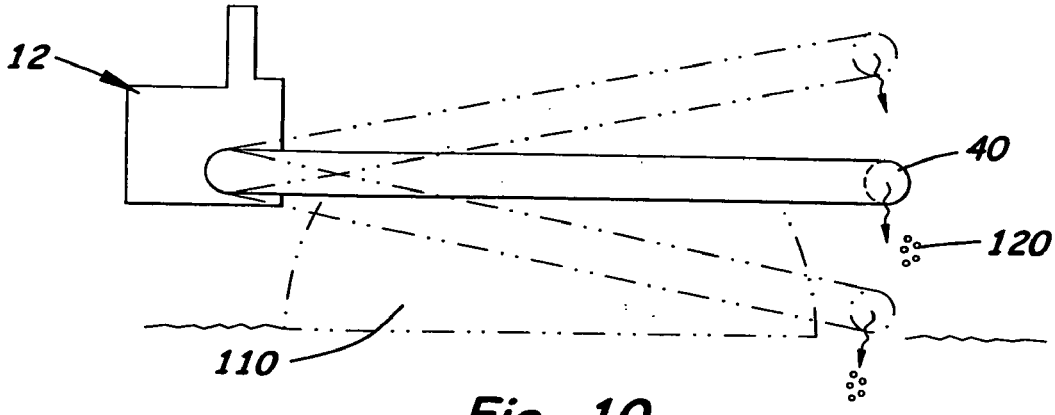
FIG. 10 is a side elevational view of the attachment head and the liquid dispensing ring showing the movement of the dispensing ring on the adapter.

The liquid delivery ring 40 is a hollow tube with a plurality of jet openings 46 formed on its lower surface 41 through which liquid 120 delivered to the ring 40 may flow. The ends of the ring 40 are open and extend inward and slide inside the two openings on the transversely liquid conduit 19. The O-rings 29 located near the two outer openings extend around the ends of the ring 40 to create a water tight seal between the ring 40 and the adapter 12. The ring 40 is generally circular or oval in shape as shown in FIG. 9. The two tips of the ring 40 are bent inward perpendicular to the sides of the adaptor 12 and longitudinally aligned with the transverse liquid conduit 19. When the tips are inserted into the transverse liquid conduit 19, the front edge of the ring 40 is able to swivel upward and downward thereby allowing the user to adjust the pitch of the ring 40 with respect to the head to control the area of the work surface 5 that is wet (see FIG. 10).

Figure 5:
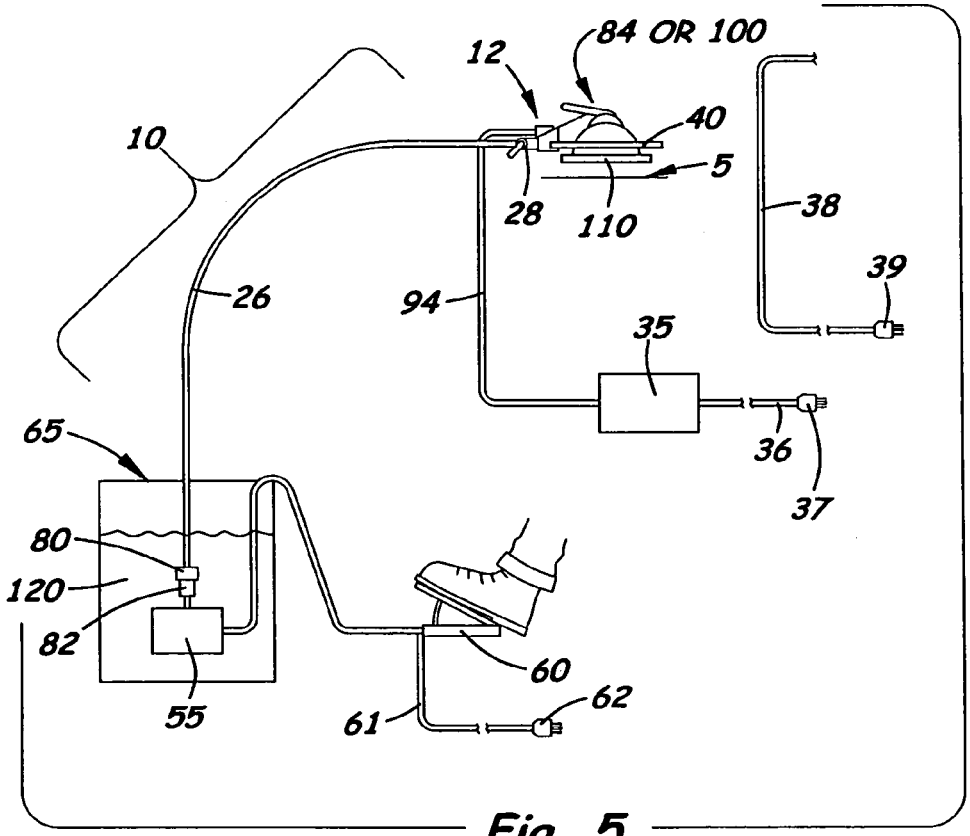
FIG. 5 is a schematic diagram of the orbital sander and the liquid dispensing system.

As shown in FIG. 5, the distal end of the liquid delivery tube 26 is connected to an electric pump 55. In the preferred embodiment, a foot switch 60 is connected to the pump 55 which allows the user to easily control the delivery of liquid 120 to the sander 84. In the preferred embodiment, the front switch 60 is a momentary switch which moves between ON and OFF positions. In the preferred embodiment, the liquid 120 is placed into a large bucket 65 and the pump 55 is then submerged in the liquid 120. In the preferred embodiment, a manual valve 28 is attached to the proximal end of the liquid delivery tube 26 allowing the operator to selectively control the volume of liquid 120 delivered to the sander 84. A check valve 82 is attached to the liquid delivery tube 26 near the distal end which prevents liquid 120 from back flowing into the liquid delivery tube 26. By preventing the back flow of liquid 120, the column of liquid 120 in the tube 26 is maintained so that instant ON or OFF action is provided by the foot switch 60. Also attached to the liquid delivery tube 26 is an optional micro filter 80.

As mentioned above the liquid dispenser is designed to be use with both pneumatic and electric powered sanders 84, 100. When used with a pneumatic sander 84, an air pressure line 94 connects at one end to the air inlet port 92. The opposite end of the air pressure line 94 connects to an electric compressor 35. The electric compressor 35 includes an electrical power cord 36 with a standard 115 volt A.C. plug 37 attached at one end. When used with an electric sander 100 the air pressure line 94, compressor 35 and power cord 36 are all replaced with a single electric power cord 38 that connects at one end to the sander 100, and at the other end to an electric plug 39 as shown in FIG. 5.

Figure 11:
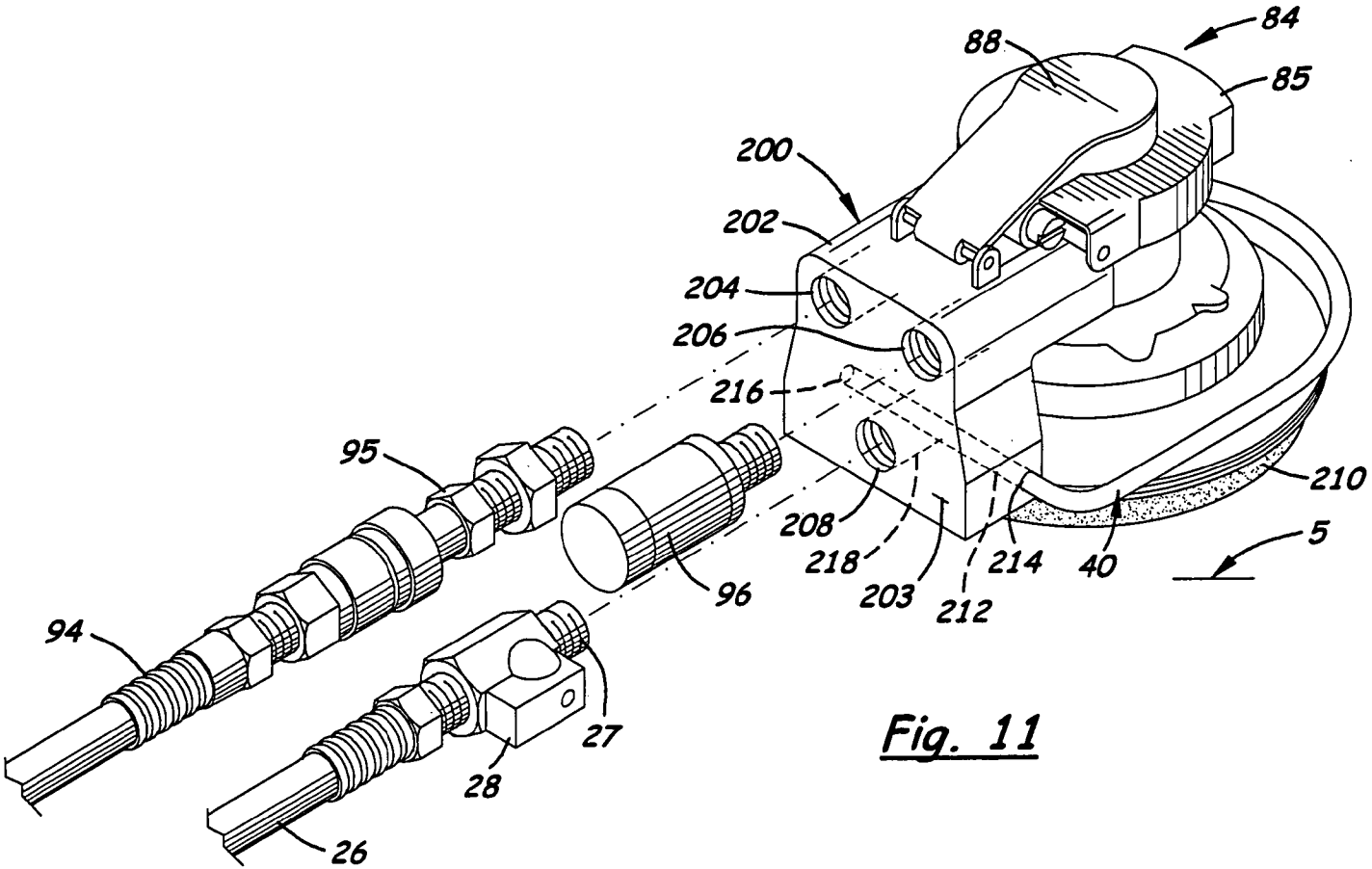
FIG. 11 is a perspective view of a second embodiment of the orbital sander with a modified head with an air inlet port, an exhaust port, a main liquid conduit, a transverse liquid conduit and two side openings in which the two ends of a ring attaches.
Figure 12:
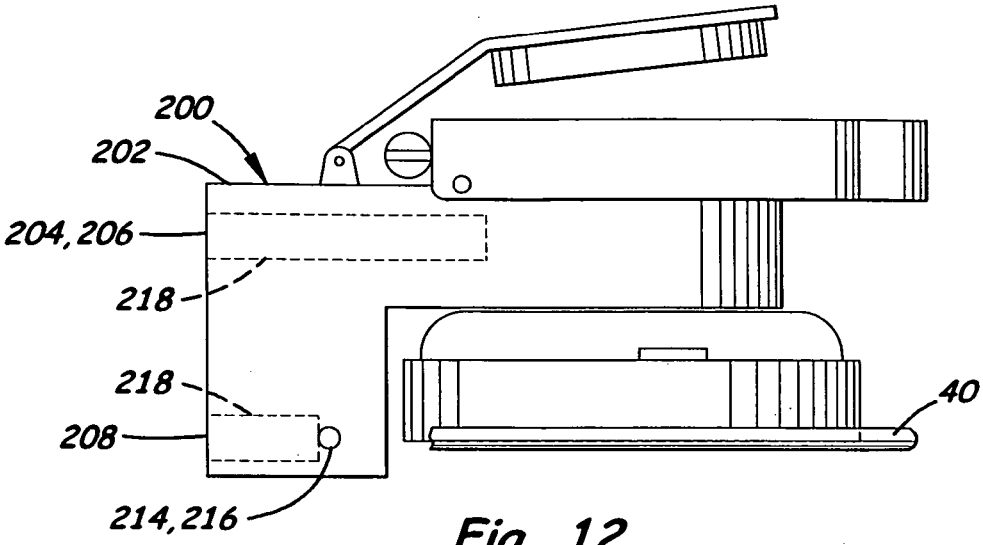
FIG. 12 is a side elevational view of the modified head shown in FIG. 13.
Figure 13:
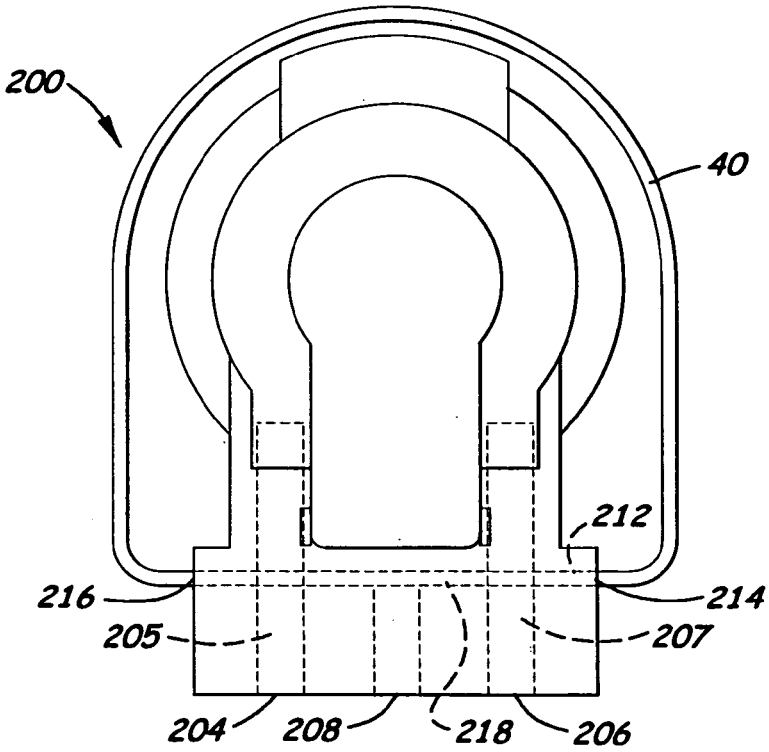
FIG. 13 is a top plan view of the modified head shown in FIG. 11.

Shown in FIGS. 11-13, is a second embodiment of the dispenser 10 that includes a modified head 200 so that the adapter 12 is eliminated. The modified head 200 includes an extended body section 202 that terminates at a flat rear surface 203. Formed on the rear surface 203 are an air inlet port 204, an exhaust port 206, and a main liquid port 208. Connected to the air inlet port 204 is an internal air inlet passageway 205. Connected to the exhaust port 206 is an internal exhaust passageway 207. Formed inside the extended body section 202 is a transverse liquid conduit 212 that is perpendicular to the main liquid conduit 218. The opposite ends of the transverse liquid conduit 212 forms two side openings 214, 216 for the ring 40. The side opening 214, 216 may includes optional o-ring recesses (not shown) as used in the adapter 12. As shown in FIG. 11, the main liquid conduit 216 connects to the transverse liquid conduit 212.

Figure 14:
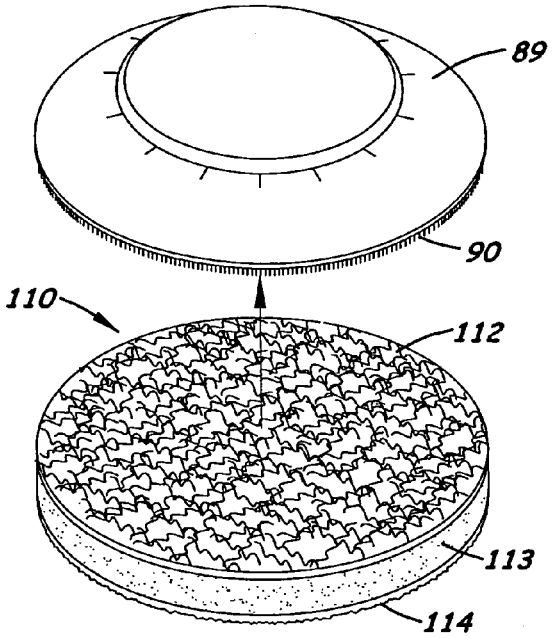
FIG. 14 is an exploded, perspective view of a foam sanding disc attached to the rotating disc on the orbital sander.
Figure 15:
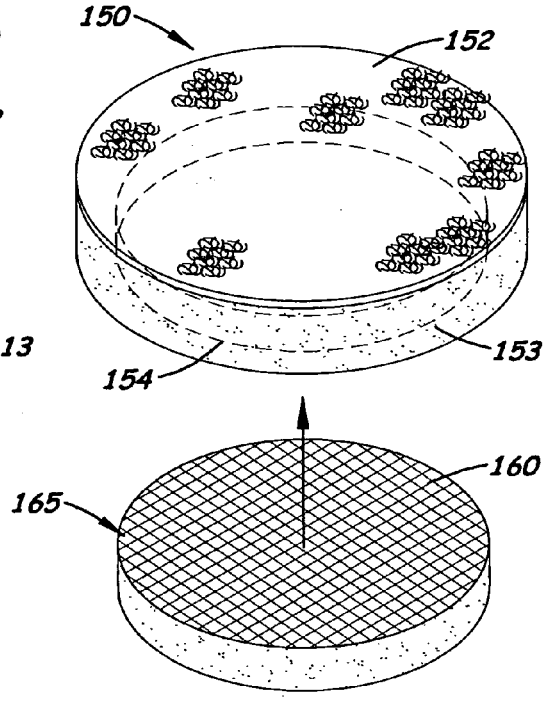
FIG. 15 is an exploded, perspective view an optional clay disc and holder that is used in place of the foam sanding disc.
Figure 16:
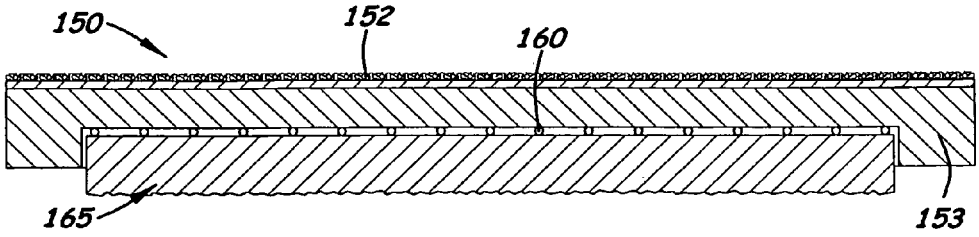
FIG. 16 is a sectional side elevational view of an assembled clay disc and clay disc holder.

Shown in FIG. 14, a support disc 89 commonly used on a pneumatic sander 84 or an electric sander 100 includes a lower surface covered with releasable hook connector layer 90. Attached to the layer 90 is a replaceable sanding or polishing foam disc, generally denoted as 110. The disc 110 includes a center foam body 113 covered by an upper loop covered layer 112 and a lower grid layer 114. The layer 112 is designed to connect to the layer 90 on the sander. The center foam layer 113 measures between ¼ and ½ inch thick.

In addition to foam discs 110, special clay discs 165 may be used with the dispenser. Clay is commonly used as an abrasive on automobile surfaces. Currently, clay is sold in large containers which the user grasps and manually rubs onto a surface. When clay is used with a liquid on a working surface, it is especially useful. In this application, clay is molded into large rolls which are then cut into the standard sander or with a liquid dispensing device sander attached thereon.

In the preferred embodiment, the clay disc 165 measures approximately ¼ to ½ inches thick and 5 inches in diameter. In order to attach the clay disc 165 to the sander, an intermediate adapter 150 must be used to hold the disc 165 and prevent it from rotating. As shown in FIG. 12, the intermediate adaptor 150 is a cylinder structure with a circular upward extending void area 154 designed to receive the clay disc 165. The intermediate adaptor 150 is made of foam and approximately ½ to ¾ inches thick and approximately 6 inches in diameter. A loop connector layer 152 is attached to its top surface which connects to the hook connector layer 90 on the support disc 89. Disposed over the top surface of the clay disc 165 is a nylon mesh disc 160. When assembled, the mesh disc 160 is pressed into the inside surface of the cavity 154 and against the top surface of the clay disc 165. The mesh disc 160 securely holds a flat clay disc 165 inside the cavity 154 and prevents the clay disc 165 from rotating.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. An orbital sander with liquid dispenser, comprising:

a. an orbital sander, said sander includes a head with a motor mounted therein, said sander including a rotating support disc capable of selectively attaching to a sanding or polishing disc, said head including a transverse liquid conduit with two side openings and a main liquid conduit in communication with said transverse liquid conduit;

b. a liquid delivery tube connected at one end to said main liquid conduit in said head;

c. a pump attached to said liquid delivery tube; and, d. a liquid delivery ring attached to said head, said ring including two opposite ends that are inserted into side opening formed on said head, said ring includes a plurality of jet openings formed on its lower surface.

2. The sander dispenser as recited in claim 1, further including means for selectively controlling the flow of liquid through said liquid delivery tube to said head.

3. The sander dispenser as recited in claim 2, wherein said means for selectively controlling the flow of liquid is a manual switch.

4. The sander dispenser as recited in claim 3, where said means for selectively controlling the flow of liquid in said liquid delivery tube is a foot operated switch connected to said pump.

5. The sander dispenser as recited in claim 3, further including an O-ring void and an O-ring located in said transverse conduit to create a water tight seal round said ring and said head.

6. The sander dispenser as recited in claim 2, where said means for selectively controlling the flow of liquid in said liquid delivery tube is a foot operated switch connected to said pump.

7. The sander dispenser as recited in claim 6, further including an O-ring void and an O-ring located in said transverse conduit to create a water tight seal round said ring and said head.

8. The sander dispenser as recited in claim 1, further including an O-ring void and an O-ring located in said transverse conduit to create a water tight seal round said ring and said head.

9. The sander dispenser as recited in claim 1, further including a filter connected to said liquid delivery tube.

10. The sander dispenser as recite in claim 1, further including a clay disc attached to said support disc.

11. The sander dispenser as recite in claim 10, further including a clay disc holder with a upward extending cavity formed therein that receives said clay disc.

12. The sander dispenser as recited in claim 10, further including a nylon mesh disposed between said clay disc holder and said clay disc.

13. An orbital sander with liquid dispenser, comprising:

a. an orbital sander, said sander includes a head with a motor mounted therein, said sander including a rotating support disc capable of selectively attaching to a sanding or polishing disc, said head including a transverse liquid conduit and a main liquid conduit in communication with said transverse liquid conduit, said head also includes an air inlet port that is aligned and registered with an air inlet port on said sander and an exhaust air valve port;

b. a liquid delivery tube connected at one end to said main liquid conduit in said head;

c. a pump attached to said liquid delivery tube;

d. a foot operated switch connected to said pump; and, e. a liquid delivery ring attached to said head, said ring including two opposite ends that are inserted into said transverse liquid conduit and a plurality of jet openings formed on its lower surface.

* * * * *